US010014622B2

(12) United States Patent
Kondo

(10) Patent No.: US 10,014,622 B2
(45) Date of Patent: Jul. 3, 2018

(54) CONNECTOR

(71) Applicant: Yazaki Corporation, Tokyo (JP)

(72) Inventor: Fuminori Kondo, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/795,513

(22) Filed: Oct. 27, 2017

(65) Prior Publication Data

US 2018/0131123 A1 May 10, 2018

(30) Foreign Application Priority Data

Nov. 9, 2016 (JP) ..... 2016-218848

(51) Int. Cl.

| | |
|---|---|
| ***H01R 43/24*** | (2006.01) |
| ***H01R 13/52*** | (2006.01) |
| ***H01R 13/405*** | (2006.01) |
| ***H01R 13/41*** | (2006.01) |
| *H01R 24/28* | (2011.01) |

(52) U.S. Cl.

CPC ..... *H01R 13/521* (2013.01); *H01R 13/41* (2013.01); *H01R 43/24* (2013.01); *H01R 24/28* (2013.01)

(58) Field of Classification Search

CPC ..... H01R 43/24; H01R 24/28; H01R 13/405; H01R 13/52165

USPC ..... 439/521, 606

See application file for complete search history.

(56) References Cited

U.S. PATENT DOCUMENTS

| | | | | |
|---|---|---|---|---|
| 6,219,913 | B1 * | 4/2001 | Uchiyama | H01R 43/24 29/876 |
| 6,294,851 | B1 * | 9/2001 | Matsuyama | H01R 43/24 29/596 |
| 9,871,317 | B2 * | 1/2018 | Zhang | H01R 13/5216 |
| 2004/0069627 | A1 * | 4/2004 | Oda | G01L 19/0084 29/592.1 |
| 2005/0204823 | A1 * | 9/2005 | Murai | G01L 19/0084 73/724 |
| 2008/0024687 | A1 * | 1/2008 | Hisaeda | H01R 13/428 349/29 |
| 2014/0038459 | A1 | 2/2014 | Kobayashi | |
| 2015/0024637 | A1 * | 1/2015 | Osada | H01R 13/42 439/655 |
| 2016/0006156 | A1 * | 1/2016 | Shimizu | H01R 24/86 439/310 |

FOREIGN PATENT DOCUMENTS

JP 2012-226832 A 11/2012

* cited by examiner

*Primary Examiner* — Briggitte R Hammond
(74) *Attorney, Agent, or Firm* — Sughrue Mion, PLLC

(57) ABSTRACT

A connector comprising a terminal that is connected to an electric wire, and a resin housing that houses and holds the terminal, wherein one groove or a plurality of grooves, each of which includes a directional component perpendicular to the lengthwise direction of the electric wire and has protrusions on the surface thereof, extends across a region of a portion of the surface of the terminal, and the terminal is embedded and secured within the resin that constitutes the housing in this portion including the region across which the groove extends. By employing this type of structure, the number of components can be reduced, and excellent bonding and airtightness is achieved between the terminal and the housing.

7 Claims, 7 Drawing Sheets

CONNECTOR

CROSS-REFERENCE TO RELATED APPLICATIONS

This application is based upon and claims the benefit of priority from the prior Japanese Patent Application No. 2016-218848, filed on Nov. 9, 2016, the entire contents of which are incorporated herein by reference.

BACKGROUND OF THE INVENTION

1. Field of the Invention

The present invention relates to a connector. Specifically, the present invention relates to a connector with a resin housing that can be used in a wire harness or the like.

2. Description of the Related Art

Connectors located at the terminals of wire harnesses and used as the points of connection with electrical equipment exist in various forms. One known example is a shielded connector that can be used for high-voltage applications (for example, see JP 2012-226832 A).

Examples of conventional configurations for connectors for high-voltage motors, and in particular connectors used in oil-proof applications, include known connectors having the following members. Specifically, these connectors include (1) a terminal that connects to an electric wire terminal, (2) an electric wire that connects to an electrical device, (3) a housing that ensures satisfactory levels of insulation, terminal holding, O-ring compression, and compression of rubber plugs and packing, (4) an O-ring for preventing the penetration oil from the motor (and oil-proofing the region between the terminal and the housing), (5) a holder that secures the O-ring, (6) a rubber plug for preventing water from entering the connector (and waterproofing the region between the wire and the housing), and (7) a rear holder that presses against the rubber plug and restricts bending of the electric wire. In this manner, conventional connectors for high-voltage motors have an extremely large number of components, resulting in a number of problems, including (a) high component costs, (b) high assembly costs, (c) complex component management, and (d) difficulty in implementing space-saving measures.

The use of syndiotactic polystyrene (hereafter also abbreviated as "SPS") as the housing material for high-voltage connectors is already known. SPS exhibits favorable heat resistance and oil resistance, and is therefore very useful as a housing material. However, chemical bonding using adhesives tends to be problematic, because the favorable oil resistance tends to be a hindrance to achieving good adhesion. Accordingly, bonding and holding a variety of members inside an SPS housing is difficult. Improving the adhesiveness of SPS by using a UV treatment to introduce functional groups at the SPS terminal groups is one possibility, but this functionality tends to deteriorate over time, and is therefore not a completely satisfactory solution.

Furthermore, acrylic rubber materials are widely used as sealing components for connectors for the purpose of oil-proofing. However, sealing components formed from acrylic rubbers can sometimes split during assembly upon contact with the corners of terminals, resulting in a deterioration in the airtightness, and making it difficult to ensure satisfactory waterproofing and oil-proofing.

BRIEF SUMMARY OF THE INVENTION

The present invention has been developed in light of the above problems associated with the conventional technology. An object of the present invention is to provide a connector which has excellent bonding and airtightness between the terminal and the housing, and for which the number of components can be reduced.

A connector according to a first aspect of the present invention has a terminal that is connected to an electric wire, and a resin housing that houses and holds the terminal, wherein one groove or a plurality of grooves, each of which includes a directional component perpendicular to the lengthwise direction of the electric wire and has protrusions on a surface thereof, extends across a region of a portion of the surface of the terminal, and the terminal is embedded and secured within the resin that constitutes the housing in this portion containing the region across which the groove extends.

A connector according to a second aspect of the present invention relates to the connector of the first aspect, wherein the connector also includes an electric wire connection portion that connects the terminal and the electric wire, an electric wire coating that coats the electric wire, and a waterproof coating portion that is provided spanning the electric wire connection portion and the electric wire coating, and at least the region of the terminal across which the groove extends, the electric wire connection portion and the waterproof coating portion are embedded and secured within the resin that constitutes the housing.

A connector according to a third aspect of the present invention relates to the connector of the first or second aspect, wherein the height from the groove surface of the protrusions on the surface of the groove is 5 μm or greater.

A connector according to a fourth aspect of the present invention relates to the connector of any of the first to third aspects, wherein a ratio (X/Y) between the groove depth (X) and the groove width (Y) of the groove that extends across the terminal is 2 or greater.

A connector according to a fifth aspect of the present invention relates to the connector of any of the first to fourth aspects, wherein 6 or more grooves extend across the terminal.

A connector according to a sixth aspect of the present invention relates to the connector of any of the first to fifth aspects, wherein the peel strength between the housing and the terminal, measured in accordance with the ISO 19095 series, is 4 N or greater.

A connector according to a seventh aspect of the present invention relates to the connector of any of the first to sixth aspects, wherein the airtightness between the housing and the terminal, measured under a condition A described below, is 50 kPa or greater.

(Condition A) Compressed air is blown between the housing and the terminal from one side of the connector, the pressure of the compressed air is increased from 10.0 kPa to 400.0 kPa in constant intervals every 30 seconds, and the pressure of the compressed air when air leakage is detected at the other side of the connector is deemed the airtightness pressure.

The present invention enables a connector to be provided which has excellent bonding and airtightness between the terminal and the housing, and for which the number of components can be reduced.

DETAILED DESCRIPTION OF THE INVENTION

Figure 1:
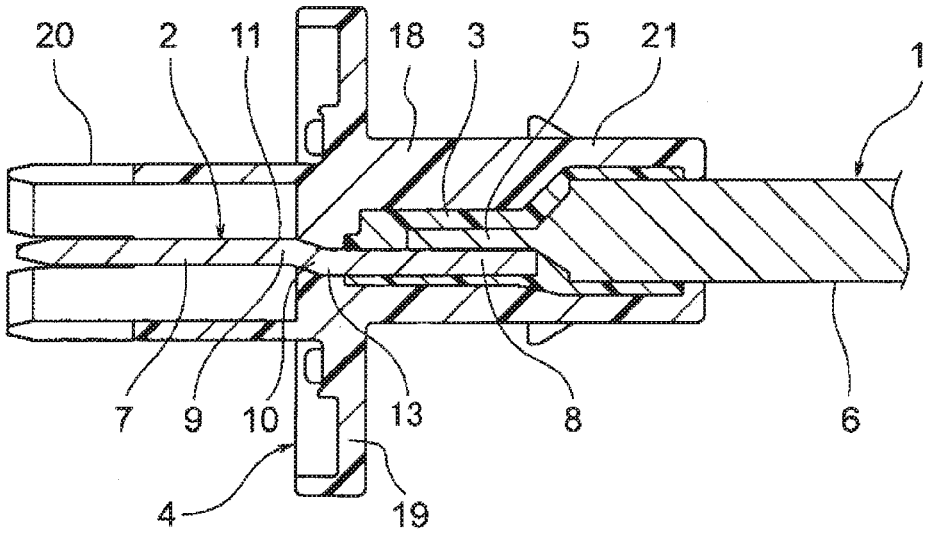
FIG. 1 is a cross-sectional view illustrating a portion of a connector according to an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

FIG. 1 is a cross-sectional view illustrating a portion of a connector according to an embodiment of the present invention. In the connector illustrated in FIG. 1, a terminal 2 is housed and held inside a resin housing 4, and the terminal 2 is connected to an electric wire 1 that extends externally.

The electric wire 1 is a conducting wire for electrically connecting any of various devices, and the present embodiment includes three of these wires. Each wire 1 has a conductor 5 and an insulator 6 (electric wire coating) that covers this conductor 5. The electric wire 1 is formed, for example, with a circular cross-sectional shape. At the terminal of the electric wire 1, the insulator 6 is removed along a predetermined length, thereby exposing the conductor 5. The conductor 5 is formed from a conductive material such as aluminum, an aluminum alloy, copper or a copper alloy, and may have, for example, a conducting structure composed of a stranded wire.

Figure 2:
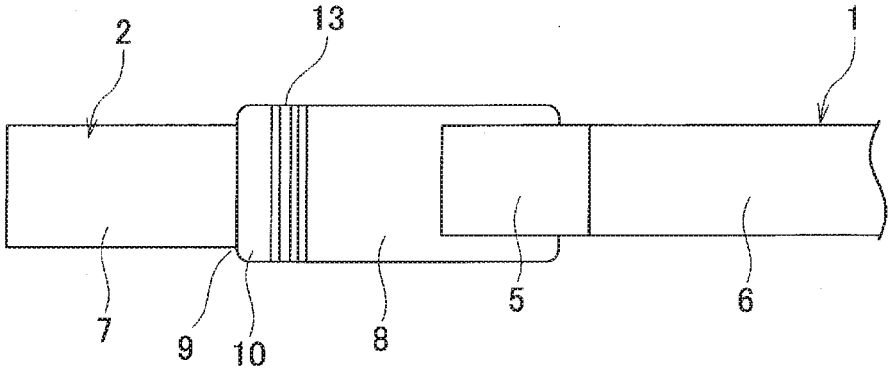
FIG. 2 is a top view illustrating a terminal positioned inside the connector illustrated in FIG. 1.
Figure 3:
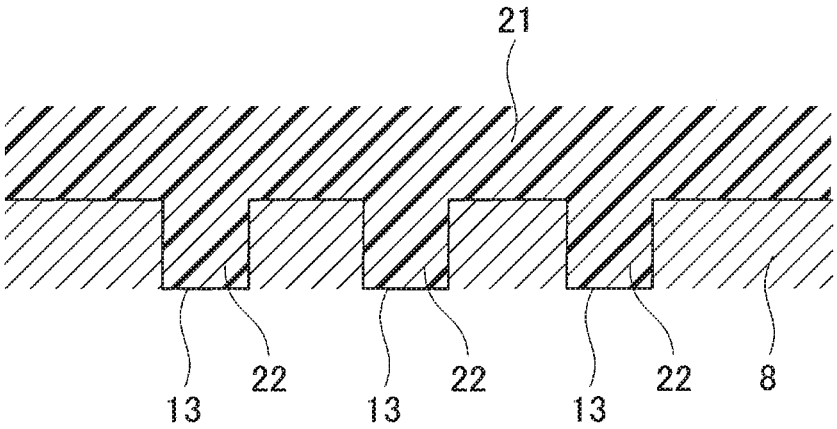
FIG. 3 is a cross-sectional view illustrating the appearance of a resin solidified inside grooves extending across a terminal.

In FIG. 1 and FIG. 2, the terminal 2 is formed by press working a metal sheet of copper or a copper alloy, and in the present embodiment, is formed as a strip-like plate with an intermediate step. The terminal 2 having this type of shape has an electrical connection portion 7 that connects to an opposing terminal not shown in the drawings, an electric wire connection portion 8 that is connected to the conductor 5 at the terminal of the electric wire 1, and a linking portion 9 between the electrical connection portion 7 and the electric wire connection portion 8.

The linking portion 9 is disposed in the central portion of the terminal 2. The linking portion 9 includes a step portion 10, and the electrical connection portion 7 and the electric wire connection portion 8 are formed as plates on either side of this step portion 10, thus forming a substantially crank-shaped terminal. A plurality of grooves 13 extend across the electric wire connection portion 8.

The plurality of grooves 13 that extend across the electric wire connection portion 8 are formed in a perpendicular direction to the lengthwise direction of the electric wire 1, and are formed around the entire periphery of the outer surface of the electric wire connection portion 8. Details relating to these grooves 13 are described below.

On the other hand, in order to ensure that the conductor 5 portion of the electric wire 1 is not exposed, a waterproof coating portion 3 formed from a resin material is formed spanning the electric wire connection portion 8 of the terminal 2 and the insulator 6 of the electric wire 1. The waterproof coating portion 3 can be formed by the type of primary molding described below.

The housing 4 is a resin molded article with insulating properties, and has a housing main body 18, and an integrated flange portion 19 that is disposed around the central portion of the housing main body 18.

A connector engagement portion 20, inside of which is disposed the electrical connection portion 7 of the terminal 2, and an insert portion 21, inside of which are insert-molded the linking portion 9 of the terminal 2 and the waterproof coating portion 3, are formed integrally with the housing main body 18.

As described above, a plurality of grooves 13 having protrusions on the surfaces thereof extend in a direction perpendicular to the lengthwise direction of the electric wire 1, around the entire periphery of the outer surface of the electric wire connection portion 8 of the terminal 2. As illustrated in FIG. 1, in the region where the terminal 2 is covered by the insert portion 21 and the grooves 13 extend around the outer periphery, the terminal 2 is embedded and secured within the resin that constitutes the housing 4. During insert molding, the resin material flows into the plurality of grooves 13 and solidifies, thus forming a plurality of terminal-securing portions 22. In other words, because of the existence of the grooves 13, the contact surface area between the metal and the resin increases, resulting in improved bonding strength between the two. Further, because any gas or liquid entering the connector is blocked by these terminal-securing portions 22, good connector airtightness can be ensured. Accordingly, favorable airtightness can be ensured without requiring a separate component such as an O-ring.

Figure 4:
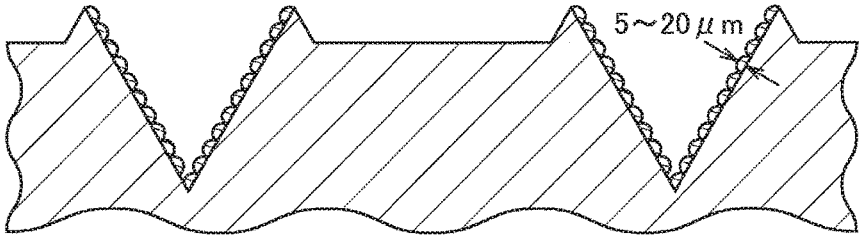
FIG. 4 is a cross-sectional view schematically illustrating grooves extending across a terminal, and protrusions provided on the surfaces of the grooves.
Figure 5A:
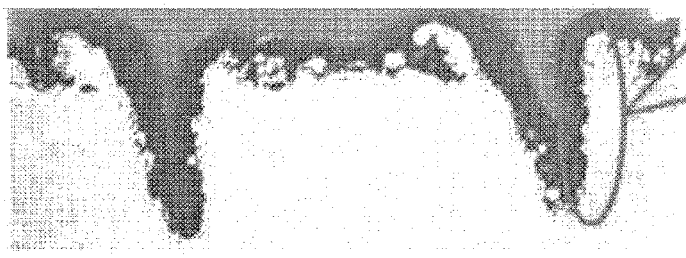
FIG. 5A is a diagram illustrating the surfaces of grooves extending across a terminal.
Figure 5B:
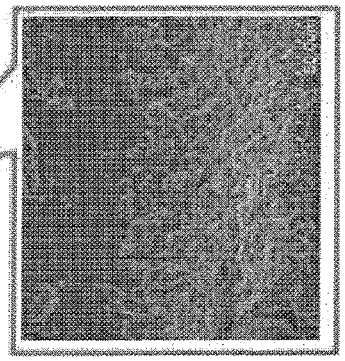
FIG. 5B is an electron microscope photograph showing an enlargement of a portion of the cross section of FIG. 5A.

Further, by providing unevenness on the surfaces of the grooves 13, the bonding strength can be further improved through an anchoring effect. FIG. 4 is a diagram schematically illustrating the grooves and a series of protrusions provided on the surfaces of the grooves, and FIG. 5A and FIG. 5B are electron microscope photographs illustrating grooves and groove surface protrusions formed by laser processing. If protrusions are formed on the groove surfaces as illustrated in FIG. 4 and FIG. 5, then it is clear that an improved anchoring effect will materialize. Further, from the viewpoint of ensuring a favorable anchoring effect, the height of these types of protrusions from the groove surface is preferably 5 μm or greater, and more preferably within a range from 5 to 20 μm (see FIG. 4).

In FIG. 2, a configuration is illustrated in which the grooves 13 extend in a direction perpendicular to the lengthwise direction of the electric wire 1, but in the present embodiment, the grooves 13 need only include a directional component perpendicular to the lengthwise direction. For example, the grooves 13 may extend in a direction that is inclined from the perpendicular relative to the lengthwise direction of the electric wire 1. In such a case, the grooves formed around the circumferential direction must overlap, and the lap margin is preferably not more than 15 μm. Further, the grooves themselves need not necessarily be straight lines. For example, if the grooves have a scale-like or wave-like shape and adjacent grooves overlap one another, then water ingress can be blocked by each of the grooves, meaning curved grooves may also be used.

In the embodiment described above, the grooves 13 are formed so that the depth direction of the grooves adopts a perpendicular direction relative to the surface of the terminal 2, but in order to further improve the bonding strength, the grooves are preferably formed with an inclination relative to that perpendicular direction. In such a case, the angle of inclination relative to the surface of the terminal 2 is preferably within a range from 75° to 105°.

The ratio (X/Y) between the groove depth (X) and the groove width (Y) for the grooves formed in the terminal 2 is preferably 2 or greater, and more preferably within a range from 2 to 2.7.

Either one or a plurality of the above grooves 13 are formed extending across the terminal 2, but from the viewpoints of airtightness and bonding strength, the number of grooves is preferably at least 6, and a number within a range from 17 to 45 is particularly preferred.

Further, the grooves 13 extending across the terminal 2 can be formed by machining, laser processing or press working. Of these techniques, in order to ensure satisfactory airtightness, formation of the grooves by laser processing is preferred. This type of laser processing is described in JP 2010-167475 A. Further, if the grooves are formed in the terminal by laser processing, then because the required number of grooves can be formed within the required range, and grooves of uniform shape can be formed, the bonding strength with the housing can be maintained in a superior state over a long period of time.

Examples of materials that can be used for forming the housing include thermoplastic resins such as polyethylene (PE), polypropylene (PP), polystyrene (PS), polybutylene terephthalate (PBT), polyamide 66 (PA66), aromatic polyamide (PA6T), polyphenylene sulfide (PPS), syndiotactic polystyrene (SPS), and acrylonitrile/styrene resin (AS). Of these, the use of SPS is particularly preferred. This is because SPS exhibits excellent heat resistance, oil resistance and chemical resistance, and can withstand use within an oil-cooled structure for long periods. As mentioned above, because of its excellent oil resistance, SPS tends to exhibit inferior adhesiveness, but in the present embodiment, because this problem of adhesiveness can be resolved by the grooves formed in the terminal, the benefits of SPS can be utilized effectively.

Because the material of the housing and the material of the terminal exhibit different coefficients of linear expansion under changes in temperature, it is preferable to select and use a housing material having a coefficient of linear expansion similar to that of the material of the terminal.

As mentioned above, examples of the material for forming the terminal include copper or a copper alloy, aluminum and SUS, but from the viewpoints of conductivity and workability, oxygen-free copper (C1020 1/2H) is preferred.

As described above, in the connector of the present embodiment, the bonding strength between the housing and the terminal can be increased, and for example, the peel strength between the housing and the terminal, measured in accordance with the ISO 19095 series, can be increased to a value of 4 N or greater, and even to 10 N or greater if appropriate conditions are employed.

Further, in the connector of the present embodiment, the airtightness between the housing and the terminal can also be improved, and the airtightness between the housing and the terminal measured under a condition A described below can be increased to 50 kPa or greater, or increased to 100 kPa or greater, 200 kPa or greater, or even 300 kPa or greater, if appropriate conditions are employed.

(Condition A) Compressed air is blown between the housing and the terminal from one side of the connector, the pressure of the compressed air is increased from 10.0 kPa to 400.0 kPa in constant intervals every 30 seconds, and the pressure of the compressed air when air leakage is detected at the other side of the connector is deemed the airtightness pressure.

The connector of the present embodiment described above enables a reduction in the number of components, and exhibits excellent bonding and airtightness between the terminal and the housing. The connector can be used extremely favorably as an airtight structure of a wire harness for use in electronic equipment, vehicle-mounted electrical componentry, transformer or coil power modules, or other devices, relays and sensors, and enables a shortening of the waterproofing treatment time. Consequently, the connector is not restricted to use within vehicle underfloor harnesses in automobiles and the like, or harnesses for air conditioning units and the like, and can also be applied to motor harnesses for air-cooled structures.

Next is a description of the steps required for producing the connector of the present embodiment.

Firstly, in a first step, the operation of connecting the conductor 5 at the terminal of the electric wire 1 to the electric wire connection portion 8 of the terminal 2 is performed. The connection method may employ any appropriate method such as welding, solvent welding or soldering. Further, in this step, a terminal having grooves extending across the terminal, produced in the manner described above, is used.

Subsequently, in a second step, the waterproof coating portion 3 is formed so as to span the electric wire connection portion 8 of the terminal 2 and the insulator 6 of the electric wire 1. The waterproof coating portion 3 is formed by resin molding (primary molding), and during this molding process, bridge portions linking each of the waterproof coating portions 3 are preferably formed as integrated portions of the molded product. By forming these bridging portions, the relative positions of the three terminals 2 can be stabilized, thereby simplifying the operations in the subsequent step.

Figure 6:
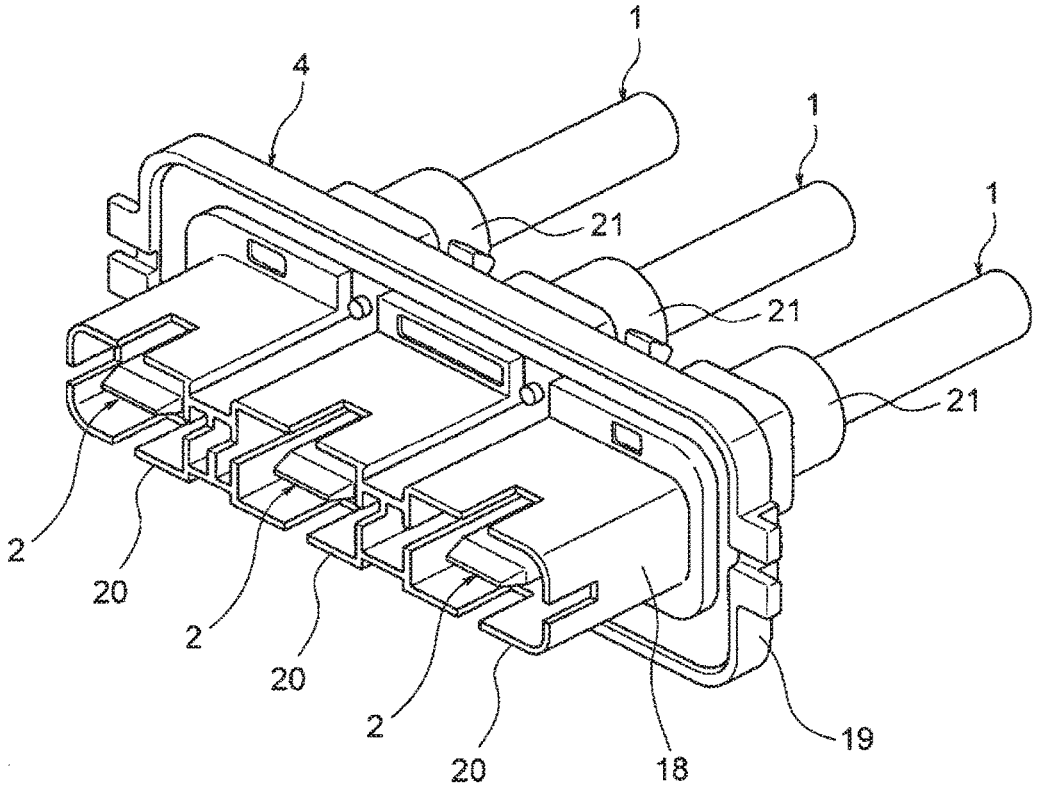
FIG. 6 is a perspective view of the connector illustrated in FIG. 1.

Next, in a third step, the housing 4 is formed by resin molding (secondary molding) as illustrated in FIG. 6. During this molding of the housing 4, the terminal 2 and the terminal portion of the electric wire 1 undergo insert molding via the linking portion 9 and the waterproof coating portion 3 respectively. As a result of this insert molding, the resin material flows into the grooves 13 and solidifies, thus forming the plurality of terminal-securing portions 22. The terminal 2 is secured by this resin molding of the housing 4.

Figure 7:
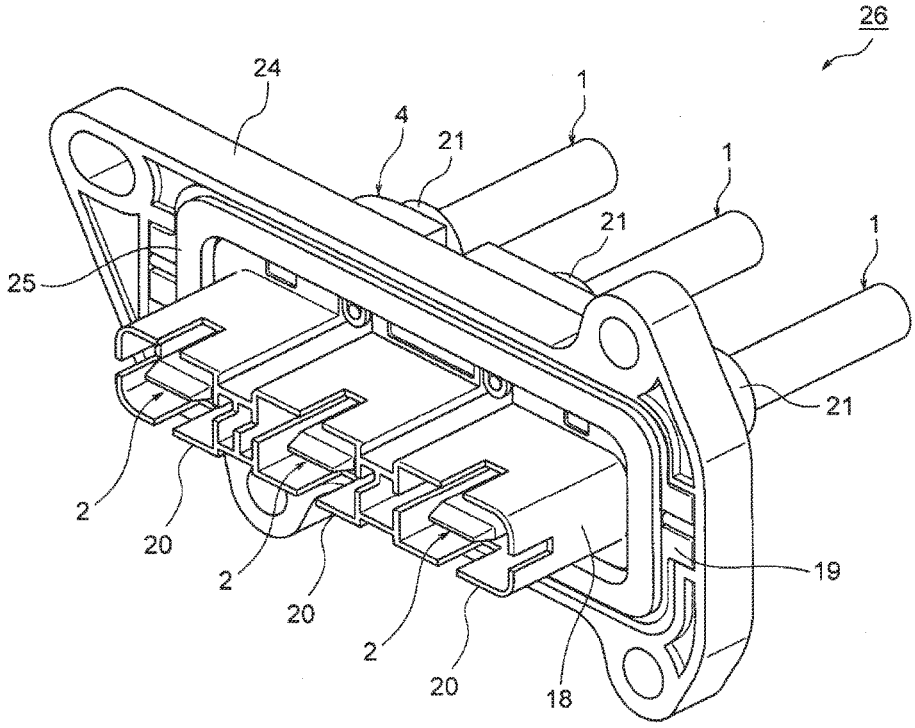
FIG. 7 is a perspective view illustrating the completed state of a connector of an embodiment applying the present invention.

Subsequently, in a fourth step, a metal shielding shell 24 and rubber unit packing 25 and the like are fitted to the housing 4, as illustrated in FIG. 7. Further, a shielding member (not shown in the drawings) that covers all three cylindrically formed electric wires 1 with a single component is also secured to the shielding shell 24. The securing of this shielding member uses a metal shield ring not shown in the drawings. Performing the steps up until this fourth step in sequence completes the assembly of the connector 26.

As described above with reference to FIG. 1 to FIG. 5, in the connector 26 according to the present embodiment, the terminal 2 can be secured to the housing 4 without using a special securing component. This is because the plurality of grooves 13 are formed in the electric wire connection portion 8 of the terminal 2, and the existence of this plurality of grooves 13 increases the contact surface area between the housing and the terminal, resulting in improved bonding strength. Further, because the ingress of external gases or liquids is blocked by the terminal-securing portions 22, the airtightness also improves.

The steps described above enable a shortening of the treatment time required for waterproofing a wire harness. Specifically, whereas at least two minutes are required for assembling a conventionally used acrylic rubber O-ring and holder, in the present embodiment, the final state already exhibits excellent airtightness, meaning the waterproofing treatment can be completed within one minute.

The present invention is described below in further detail using a series of examples, but the present invention is in no way limited by these examples.

Examples 1 to 7

Figure 8A:
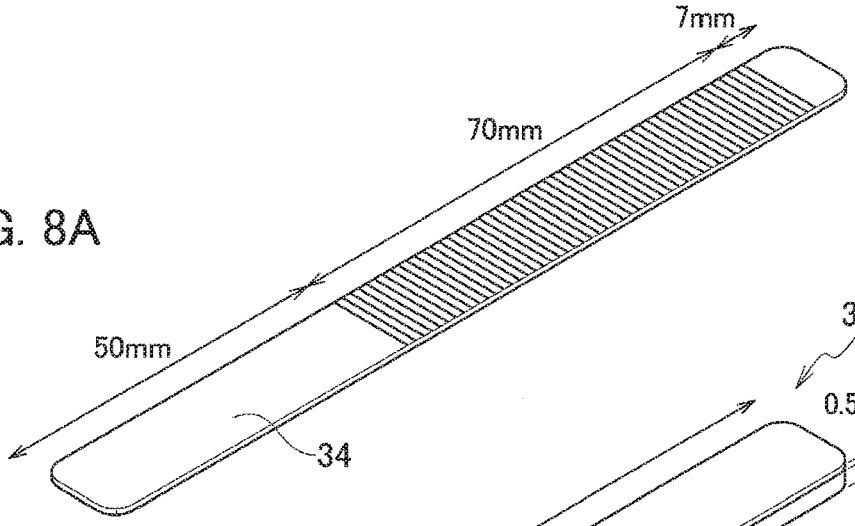
FIG. 8A is a perspective view schematically illustrating a metal piece.
Figure 8B:
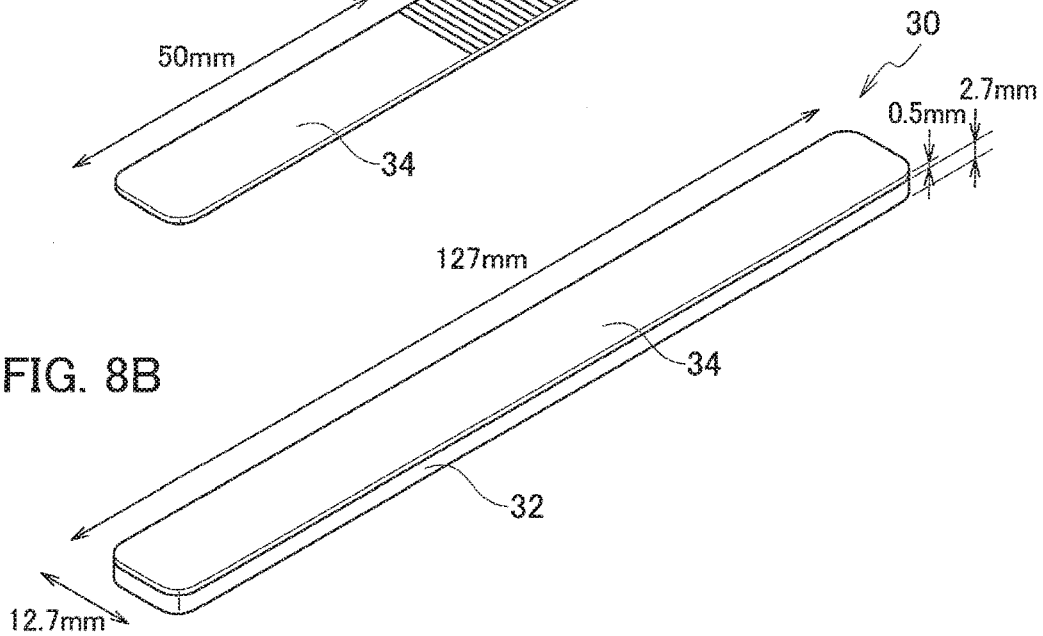
FIG. 8B is a perspective view schematically illustrating the state following integral molding of the metal piece and a resin.
Figure 8C:
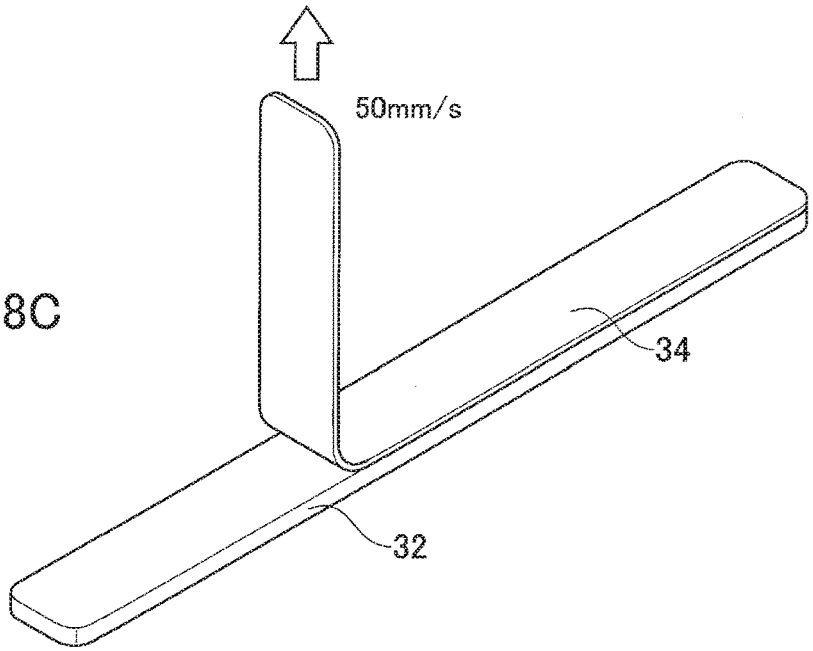
FIG. 8C is a perspective view schematically illustrating a state during a peel test, as one end of the metal piece is pulled upward.

First, a metal piece (127×12.7×0.5 mmt, coefficient of linear expansion: $17.7\times10^{-6}$/° C.) formed from oxygen-free copper (C1020 1/2H) was subjected to laser processing to form a series of grooves (see FIG. 8A). Specifically, in each example, grooves having the groove depth, groove width, ratio between groove depth and groove width, surface roughness, and number of grooves shown in Table 1 were formed (by Yamase Group Co., Ltd.) in a direction perpendicular to the lengthwise direction of the metal piece. Subsequently, the metal piece with the grooves formed therein was subjected to insert molding using a resin (S131, manufactured by Idemitsu Kosan Co., Ltd., an SPS resin, coefficient of linear expansion: $20.0\times10^{-6}$/° C.), thereby integrating the metal piece and the SPS into a single body (127 mm×12.7 mm, thickness: 2.7 mm) (see FIG. 8B). In FIG. 8A to 8C, symbol 30 indicates the molded article, symbol 32 indicates the resin, and symbol 34 indicates the metal piece.

Next, the methods described below were used to measure (1) the peel strength (in accordance with the ISO 19095 series) and (2) the airtightness between the metal piece and the resin.

Comparative Example 1

Using a metal piece identical to those used in Examples 1 to 7 but having no grooves formed in the metal, insert molding with a resin was performed in the same manner as Examples 1 to 7 to integrate the metal piece and the resin into a single body.

Comparative Examples 2 to 6

Metals pieces identical to those used in Examples 1 to 7 were subjected to laser processing to form grooves extending in a direction parallel to the lengthwise direction of the metal piece. Specifically, in each comparative example, grooves having the groove depth, groove width, surface roughness, and number of grooves shown in Table 2 were formed (by L.P.S. Works Co., Ltd.). Subsequently, insert molding with the SPS resin was performed in the same manner as Examples 1 to 7 to integrate the metal piece and the resin into a single body.

Next, (1) the peel strength (in accordance with the ISO 19095 series) and (2) the airtightness between the metal piece and the resin were measured in a similar manner to Examples 1 to 7.

(1) Peel Strength (Adhesive Strength, Bonding)

Using a 90° Peel Test Device (Autograph AG-1, a precision universal testing machine, manufactured by Shimadzu Corporation), the molded article obtained in each example and each comparative example was subjected to measurement of the peel strength at a test speed of 50 mm/min in accordance with the ISO 19095 series (see FIG. 8C). Specifically, of the 70 mm region of the metal piece in which the laser processing had been performed, and the 50 mm region in which no laser processing had been performed (see FIG. 8A), the 50 mm region having no laser processing was grasped and pulled at a speed of 50 mm/s to perform the peel test. The measurement results are shown in Table 1.

(2) Airtightness (Sealing, Waterproofing)

Figure 9:
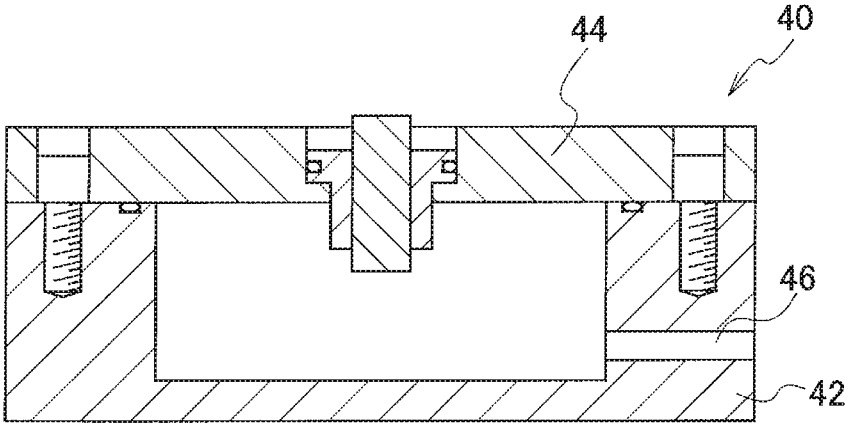
FIG. 9 is a cross-sectional view illustrating a jig used for evaluating airtightness.

An aluminum jig used for measuring the airtightness is described below with reference to FIG. 9. The jig 40 illustrated in FIG. 9 has a jig main body 42 having a circular cylindrical shape with a closed bottom, and a lid 44 that seals the open end of the jig main body 42. A vent 46 connected to the outside is provided in the jig main body 42, and compressed air is supplied to the internal space through this vent 46. A rectangular shaped opening into which the molded article undergoing airtightness measurement is inserted is provided within the central portion of the lid 44. This opening holds the molded article in a state where a portion of the molded article is exposed externally, and is watertight, so that when the molded article is held within the opening, water cannot enter the interior of the jig main body 42.

Each of the molded articles obtained in the above examples and comparative examples was placed in the jig 40, the jig was immersed in water, compressed air of 10.0 kPa was blown into the jig through a tube for 30 seconds, and the molded article was inspected for leakage of the compressed air from the watertight portion. If no leakage of the compressed air was detected, then the pressure of the compressed air was raised in intervals of 10.0 kPa, with leakage detection repeated after each interval, until 400 kPa was reached. The pressure of the compressed air when leakage was first detected was deemed the sealing pressure. A sealing pressure of 50 kPa or greater was deemed a pass (o), whereas a sealing pressure of less than 50 kPa was deemed a fail (x). The evaluation results are shown in Table 1.

TABLE 1

| | | | Example 1 | Example 2 | Example 3 | Example 4 | Example 5 | Example 6 | Example 7 |
|---|---|---|---|---|---|---|---|---|---|
| Groove depth | | μm | 80 | 80 | 60 | 80 | 80 | 80 | 80 |
| Groove width | | μm | 30 | 30 | 30 | 30 | 30 | 30 | 30 |
| Ratio (X/Y) between depth (X) and width (Y) | | | 2.7 | 2.7 | 2.0 | 2.7 | 2.7 | 2.7 | 2.7 |
| Groove roughness | | μm | 10 | 10 | 10 | 20 | 10 | 10 | 5 |
| Number of grooves | | number | 45 | 17 | 27 | 27 | 14 | 6 | 10 |
| Evaluations | Peel strength | N | 10.1 | 10.1 | 8 | 7.5 | 10.1 | 4 | 5.5 |
| | Airtightness (initial) | kPa | 330 | 210 | 200 | 200 | 110 | 50 | 60 |
| | | evaluation | ○ | ○ | ○ | ○ | ○ | ○ | ○ |

TABLE 2

| | | | Comparative Example 1 | Comparative Example 2 | Comparative Example 3 | Comparative Example 4 | Comparative Example 5 | Comparative Example 6 |
|---|---|---|---|---|---|---|---|---|
| Groove depth | | μm | 0 | 80 | 30 | 60 | 80 | 80 |
| Groove width | | μm | 0 | 30 | 30 | 60 | 30 | 30 |
| Ratio (X/Y) between depth (X) and width (Y) | | | — | 2.7 | 1.0 | 1.0 | 2.7 | 2.7 |
| Groove roughness | | μm | 1 or less | 1 or less | 5 | 5 | 1 or less | 10 |
| Number of grooves | | number | 0 | 27 | 27 | 27 | 27 | 5 |
| Evaluations | Peel strength | N | 0 (not measurable) | 6.7 | 0 (not measurable) | 0 (not measurable) | 3 | 3 |
| | Airtightness (initial) | kPa | 0 (not measurable) | 40 | 0 (not measurable) | 0 (not measurable) | 20 | 40 |
| | | evaluation | x | x | x | x | x | x |

Based on Table 1, it is evident that each of Examples 1 to 7 yielded excellent results for peel strength and airtightness. In contrast, none of the comparative examples yielded favorable results, because no surface treatment was performed in Comparative Example 1, and because the grooves were parallel to the lengthwise direction of the electric wire in Comparative Examples 2 to 6. Based on these results, it is surmised that even in those cases where a terminal and a housing are molded together by insert molding, providing grooves that extend across the terminal in a direction perpendicular to the lengthwise direction of the wire yields excellent bonding properties (peel strength) and airtightness.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

DESCRIPTION OF THE SYMBOLS

1: Electric wire
2: Terminal
3: Waterproof coating portion
4: Housing
5: Conductor
6: Insulator (electric wire coating)
7: Electrical connection portion
8: Electric wire connection portion
9: Linking portion
10: Step portion
13: Groove
18: Housing main body
19: Flange portion
20: Connector engagement portion
21: Insert portion
22: Terminal-securing portion

The invention claimed is:

1. A connector comprising a terminal that is connected to an electric wire, and a resin housing that houses and holds the terminal, wherein one groove or a plurality of grooves, each of which includes a directional component perpendicular to a lengthwise direction of the electric wire and has protrusions on a surface thereof, extends across a region of a portion of a surface of the terminal, and the terminal is embedded and secured within the resin that constitutes the housing in the portion comprising the region across which the groove extends.

2. The connector according to claim 1, further comprising an electric wire connection portion that connects the terminal and the electric wire, an electric wire coating that coats the electric wire, and a waterproof coating portion that is provided spanning the electric wire connection portion and the electric wire coating, wherein at least the region of the terminal across which the groove extends, the electric wire connection portion and the waterproof coating portion are embedded and secured within the resin that constitutes the housing.

3. The connector according to claim 1, wherein a height from the groove surface of the protrusions on the surface of the groove is 5 μm or greater.

4. The connector according to claim 1, wherein a ratio (X/Y) between a groove depth (X) and a groove width (Y) of the groove that extends across the terminal is 2 or greater.

5. The connector according to claim 1, wherein 6 or more grooves extend across the terminal.

6. The connector according to claim 1, wherein a peel strength between the housing and the terminal, measured in accordance with ISO 19095 series, is 4 N or greater.

7. The connector according to claim 1, wherein airtightness between the housing and the terminal, measured under a condition A described below, is 50 kPa or greater:

(condition A) compressed air is blown between the housing and the terminal from one side of the connector, a pressure of the compressed air is increased from 10.0 kPa to 400.0 kPa in constant intervals every 30 seconds, and a pressure of the compressed air when air leakage is detected at the other side of the connector is deemed to be airtightness pressure.

* * * * *